US005697104A

United States Patent [19]

Welton

[11] Patent Number: 5,697,104

[45] Date of Patent: Dec. 16, 1997

[54] PADDED GLOVE

[76] Inventor: Lawrence J. Welton, P.O. Box 543, Rutland, Vt. 05702

[21] Appl. No.: 784,370

[22] Filed: Jan. 17, 1997

[51] Int. Cl.[6] ..... A41D 19/00

[52] U.S. Cl. ..... 2/159; 2/161.1

[58] Field of Search ..... 2/159, 160, 161.1, 2/161.2, 161.3, 161.5, 161.6, 161.8, 16, 20

[56] References Cited

U.S. PATENT DOCUMENTS

| | | | |
|---|---|---|---|
| 2,465,136 | 3/1949 | Troccoli | 2/159 |
| 2,858,542 | 11/1958 | Ogg | 2/161.2 |
| 2,907,046 | 10/1959 | Scherr | 2/159 |
| 2,907,047 | 10/1959 | Steinberg | 2/161.2 |
| 3,096,523 | 7/1963 | Bruchas | 2/159 |
| 3,606,614 | 9/1971 | Dimitroff | 2/159 |
| 4,651,350 | 3/1987 | Dawiedczyk | 2/161.6 |
| 4,691,387 | 9/1987 | Lopez | 2/161.1 |
| 4,864,660 | 9/1989 | Sawyer | 2/161.1 |

*Primary Examiner*—Gloria Hale
*Attorney, Agent, or Firm*—Kevin Ellicott, Esq.

[57] ABSTRACT

A padded glove is constructed from pattern pieces, the pattern pieces comprising a back trank having a Standard Dress cut finger section and a Gunn cut section; a palm trank having a Standard Dress cut finger section, a Gunn cut palm section and a wing thumb section; at least 3 two-piece fitted fourchettes; a thumb back section; a padding piece section, the padding piece section having a body, the body having two lobes depending therefrom, the padding piece section being attached to the assembled glove, around the periphery of the padding piece section, the attachment attaching the padding piece section, and a padding material locatable between the padding piece section and the palm trank, along flexure areas in order to maximize bending of the padding piece section and padding material along those flexure areas.

3 Claims, 3 Drawing Sheets

PADDED GLOVE

FEDERALLY SPONSORED RESEARCH AND DEVELOPMENT

Figure 2:
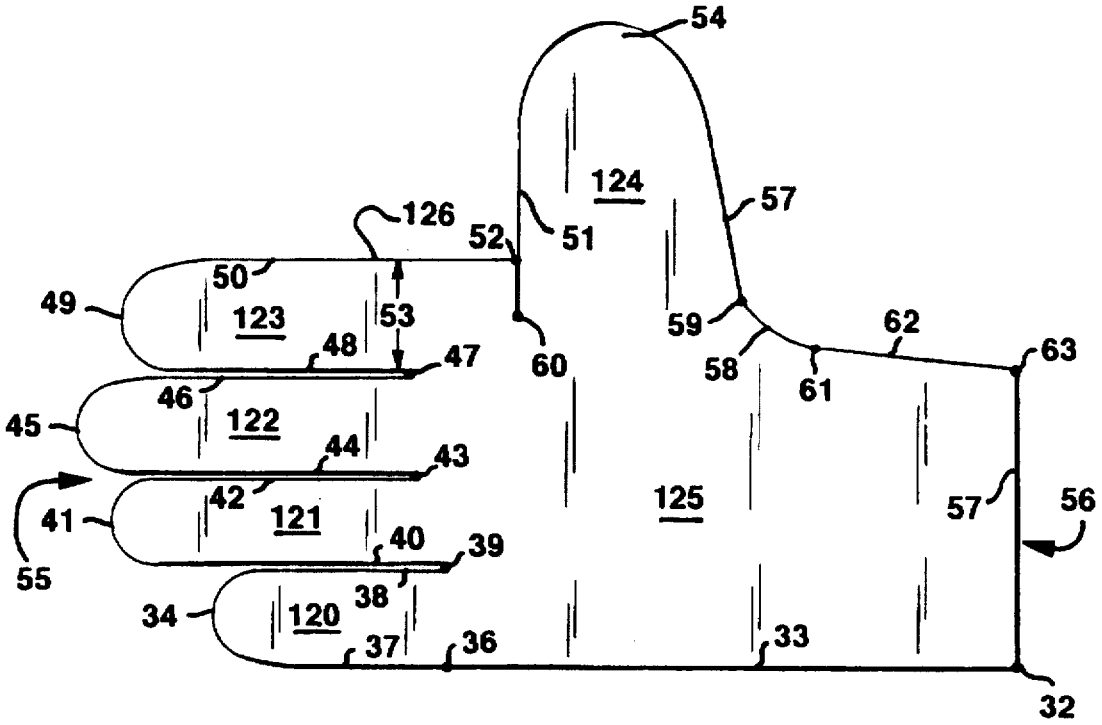

There are no federally sponsored or funded research or development projects or undertakings in any way associated with the instant invention.

BACKGROUND OF THE INVENTION

1. Field of the Invention

The instant invention relates to that field of devices consisting of articles of manufacture known as gloves, specifically, those gloves having padding sewn into them.

2. Background Information

The prior art known to applicant discloses that padded gloves and their patterns are well known. Furthermore, both the "Gunn" cut and the "Standard Dress" cut glove patterns are well known in the industry. General information regarding the Gunn cut glove may be had by reference to U.S. Pat. Nos. 3,108,285 and 3,258,782. General information regarding the Standard Dress cut glove may be had by reference to United States Military Specification number MILG24909A.

The Gunn cut glove palm trank may have one of a number of thumb patterns associated with it. The most common thumb patterns are the "Standard Gunn Thumb" pattern, the "Keystone Thumb" pattern, the "Wing Thumb" pattern and the "Set-In Thumb" pattern.

The Gunn cut palm trank is usually configured such that the palm section and the "pointer" finger and the "pinkie" finger are constructed from one piece of material. The "middle" finger and the "ring" finger are cut from a separate piece of material, and attached to the palm trank during assembly of the glove. When the "Wing thumb" or the "Standard Gunn thumb" pattern is utilized, the thumb section is continuous with the palm section, and therefore does not require attachment during assembly of the glove.

The Standard Dress glove palm trank generally has associated with it either a "Keystone Thumb", or an "Set-In Thumb". The Standard Dress glove palm trank generally has the palm section and all finger sections cut from one piece of material, thereby eliminating the need for a seam or other form of attachment between the finger section and the palm section during assembly. However, the art also teaches that when this form of palm/finger combination is used, it is necessary to cut the thumb section from another piece of material, and attach the thumb section during assembly. This necessitates a seam along the area where the thumb and palm meet.

In both the Standard dress glove and the Gunn cut glove, the portion of the glove at the finger tips is referred to as the bottom of the glove (the distal end of the glove), and the portion of the glove nearest to the wrist is referred to as the top of the glove (the proximal end of the glove). The portion of the glove where the thumb section and the palm section meet, most distally from the wrist, is referred to as the "crotch of the thumb".

In the Gunn cut pattern, the finger section of the palm trank and the finger section of the back trank are attached directly to one another. For example, looking only at the index finger, the palm trank and the back trank are placed in contact with one another. The index finger portion of the material is then attached along the periphery of the material such that the attachment begins where the finger section meets the palm section, distally toward the finger tip, around the finger tip and then proximally toward the palm section again. In the Standard Dress cut pattern, the finger sections of the palm trank and the back trank are attached to one another with an intermediary piece of material referred to as a fourchette. A common intermediary piece used in the Standard Dress cut pattern is referred to as a two piece fitted fourchette.

Padded versions of these gloves, known to applicant, are usually constructed from the Gunn cut pattern. These padded gloves have a "pad" or "patch" sewn either inside of the palm section or on top of the palm section. In the industry, a piece of material which is sewn onto another piece of material is generally referred to as a patch. When referring to applicant's patch, the term pad or padded section will usually be applied. The pads generally cover the entire surface of the palm section. The padding is usually attached along the section of the palm trank at which the most proximal end of the finger sections meet or are attached to, the palm section of the glove. This area, once assembled, corresponds to the underside of the knuckle section of the back trank. The padding is then attached along the right and left side of the palm section, following the contour of the palm section. Finally, the pad is attached along the bottom of the palm section, following roughly along where the palm of a hand would meet the wrist, once the hand has been inserted into the glove. Alternatively, gloves have been constructed such that the padding covers only the area of the palm section corresponding to the underside of the knuckle section of the front piece.

Construction in the former manner leads to a number of undesirable results. First, the presence of the padding over the entire palm section leads to a bunching up of the padding in the center of the palm when the wearer closes his or her hand. The bunching up of the padding material causes both discomfort for the wearer, as well as tending to increase the overall volume of whatever is being held within the closed hand. For example, although the circumferential dimension of a pistol grip might only be 7 inches, the bunching effect caused by the padded palm may make the pistol grip feel as though it was 10 inches in diameter. This in turn forces the wearer's hand farther open, making gripping more difficult.

Second, as the padding bunches, the glove itself has a tendency to shift, such that the section of the palm piece corresponding to the base of the thumb and the area where the skin connecting the thumb and the pointer finger meet, is no longer padded. This shifting of the padding to a large extent defeats the purpose of the padded glove, namely, to cushion the palm of the hand from vibrations emanating from and jarring impacts generated by, the article being held within the closed hand. For example, the hands of a bicycle rider holding the handlebar grips, are constantly exposed to impacts generated by the handlebar's tendency to pull away from, or push toward the rider in response to conditions encountered by the bicycle front wheel. When the padding shifts away from the thumb area, that area is unprotected from these impacts.

Construction in the latter manner provides no protection for the thumb section whatsoever. A wearer of such a padded glove who is engaged in pistol target shooting will be subject to the entire force of the recoil generated by the weapon, along the thumb section. While the latter construction protects the section of the palm corresponding to the knuckle section, it does nothing to protect the section of the palm where the skin of the thumb and the pointer finger meet.

In addition, the presence of a seam along the area of the palm trank corresponding to the knuckle section of the back trank, once assembled, places additional material under the padding which in turn makes closing a gloved hand all the more difficult. The seam created by attaching a "Keystone" or "Set-In" thumb section in the crotch of the glove further exacerbates the problems caused by excess material and reduces the wearer's ability to move the thumb easily.

Finally, the prior art teaches that the Gunn cut pattern and the Standard Dress Cut pattern are mutually exclusive. If one constructs a glove utilizing the palm section of the Standard Dress cut pattern, one is forced to attach a separate thumb section, and accept the concomitant seam. If one constructs a glove utilizing the Gunn cut pattern, one is forced to accept finger sections that are not likely to fit as well, as no fourchette is utilized during assembly, and one is forced to accept a seam along where the finger sections meet the palm section. The seams present in both patterns have deleterious effects when padding is added to the glove.

SUMMARY OF THE INVENTION

The instant invention is first a glove pattern for a padded glove incorporating a padded section and elements of both the Gunn cut pattern and the Standard Dress cut pattern. Second, the instant invention is a padded section for attachment to a glove. Third, the instant invention is the glove assembled from the above glove pattern and padded section.

The instant invention differs from the prior art, and overcomes the limitations imposed by the prior art in a number of significant ways. First, the padded glove pattern incorporates the palm section pattern of a Gunn cut glove having a Wing cut thumb pattern and the finger section pattern of a Standard Dress cut glove. By so combining, the instant invention eliminates the seams which would underlie applicant's pad section, and interfere with a wearer's ability to easily close a gloved hand.

While the prior art dictates that the Gunn cut pattern and the Standard Dress Cut pattern are mutually exclusive, applicant has discovered that the patterns may be combined, and when assembled along with applicant's padded section, yield a padded glove which does not interfere with the wearer's ability to easily close a gloved hand. Furthermore, applicant's use of the Wing cut thumb pattern in conjunction with the above combination yields a glove whose crotch will bind far less frequently, further lessening the likelihood that the padded section will shift to a position where the thumb becomes unprotected.

Second, the padded section of the instant invention will not tend to bunch up as conventional padded gloves tend to. This padded section is shaped in the form of a modified "C" (or kidney shaped), and hence is referred to as the "Welton C Patch". By shaping the padded section to conform to only those areas of the palm at which impacts and vibrations are generally transferred from articles held when gripped, the volume of padding is reduced. This reduction of padding permits the hand to be closed without a wad of useless padding bunching up in the center of the palm. In turn, removal of useless padding reduces the volume of material present when the hand is closed. This is especially helpful when the article to be gripped has a tendency to move and work the gripped hand open. By way of examples, when chopping wood, the ax, upon impact, tends to pull the hand open. Also, a pistol, when fired, tends to recoil and pull the gripped fingers open. Also, when a batter swinging a baseball or softball bat contacts a ball, the jarring impact forces the gripped fingers open. Applicant's reduction of the volume of material contained within the gripping hand yields a padded glove in which the wearer has less difficulty keeping a strong hold on the article which is being gripped.

Third, the padded section is specifically designed to provide protection to the thumb not found in any of the prior art. This is accomplished by utilizing a Wing thumb in conjunction with the novel design of the padded section. Unlike other padded sections which are fitted to cover the palm only, inventor's padded section is designed to extend up the thumb portion of the glove, to approximately the area over the most distal joint of the thumb. Hence, when the gloved hand is closed, the padded section provides protection to the area of the thumb most likely to be in contact with whatever object is being gripped.

Furthermore, use of a Wing thumb in conjunction with the padded section removes the necessity of a seam under the padded section. This is significant as locating a seam under the padded patch has a tendency to cause binding in the crotch area of the glove. It also has a tendency to cause the glove to shift its position on the hand when the gloved hand is flexed open and closed. As with the fingers, shifting of the material generally causes a reduction in wearer dexterity, and often forces the wearer to remove the gloves in order to perform tasks requiring carefully executed manual skills.

Additionally, the padded section is attached to the palm section not only around the periphery of the glove, but also along specific flexure areas on the palm. Attachment in this manner keeps the padded section from shifting and bunching up. The attachment in this fashion also promotes folding of the padded section at the flexure areas, the padded section being folded into itself rather than bulging outward, away from the palm, thereby reducing the mount of force which must be exerted by a wearer in order to close a gloved hand. Prior art gloves have failed to recognize the need for such attachments, and therefore have further exacerbated the tendency of the padding to bunch up in the center of the palm.

Fourth, the assembled glove incorporates the finger construction usually found only in Standard Dress Cut gloves. This is extremely significant to the user of such a glove as it yields a glove which fits the wearer's hand much more closely than would be the case if the glove were constructed using the Gunn cut glove fingers. Normally, gloves constructed from the Gunn cut pattern do not fit well in the area where the material comprising two adjacent fingers meet the palm section. This ill fit often causes a gap between the most distal end of a wearer's finger, and the interior portion of the most distal end of the glove finger. Furthermore, the finger material of the glove generally has a tendency to "ride up" the wearers hand. This movement of the glove has the undesirable effect of reducing a wearer's manual dexterity and shifting the padding. For example, a wearer who is actively pistol target practicing while wearing a padded glove constructed from the Gunn cut pattern will find it extremely difficult to manipulate rounds of ammunition when attempting to reload the pistol. The riding up of the glove will interfere with the target shooter's dexterity while handling ammunition, and force the wearer to remove the gloves each time the pistol needs to be reloaded. Applicant's incorporation of the Standard Dress cut finger pattern virtually removes this difficulty. By utilizing two piece fitted fourchettes to connect the finger sections of palm trank and the back trank, applicant's glove tends to fit far better than a glove constructed from a Gunn cut pattern. Because the fingers tend to fit better, they do not ride up the wearer's hand as easily. Thus applicant's glove stays put on the wearer's hand and does not interfere with the wearer's dexterity and ability to manipulate objects with the gloved hand.

A DESCRIPTION OF THE DRAWINGS

Figure 1:
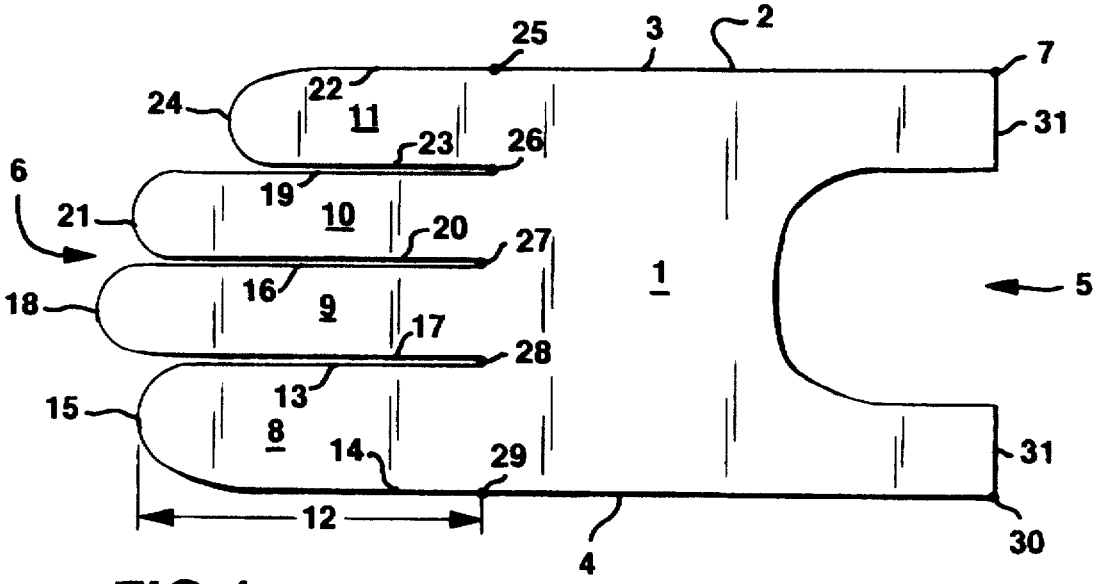

1) FIG. 1 is an elevational view of a right glove back trank. The lobes which comprise the finger section have been cut apart. The right and left glove back tranks are mirror images of one another, hence only the right is shown.

2) FIG. 2 is an elevational view of a right glove palm trank. The lobes which comprise the finger section have been cut apart. The thumb crotch line has not yet been cut. The right and left glove palm tranks are mirror images of one another, hence only the right is shown.

Figure 3:
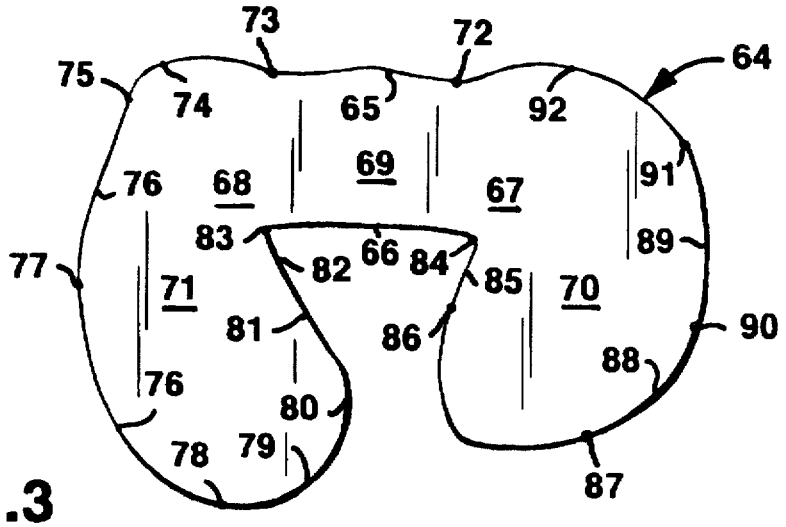

3) FIG. 3 is an elevational view of a right glove padding section. The right and left glove padding sections are mirror images of one another, hence only the right is shown.

Figure 4:
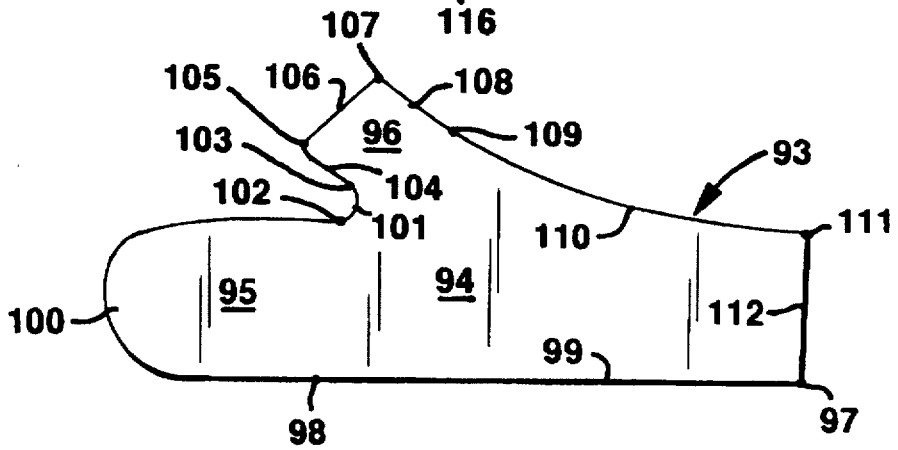

4) FIG. 4 is an elevational view of a right glove thumb back section. The right and left glove thumb back sections are mirror images of one another, hence only the right is shown.

Figure 5:
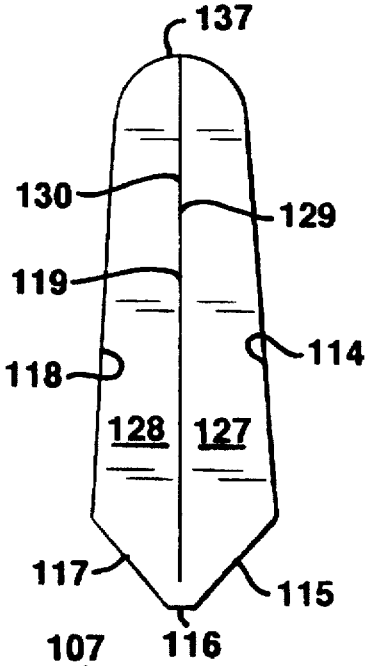

5) FIG. 5 is an elevational view of a two piece fitted fourchette. The two piece fitted fourchette has not yet be cut along a center cut line.

Figure 6:
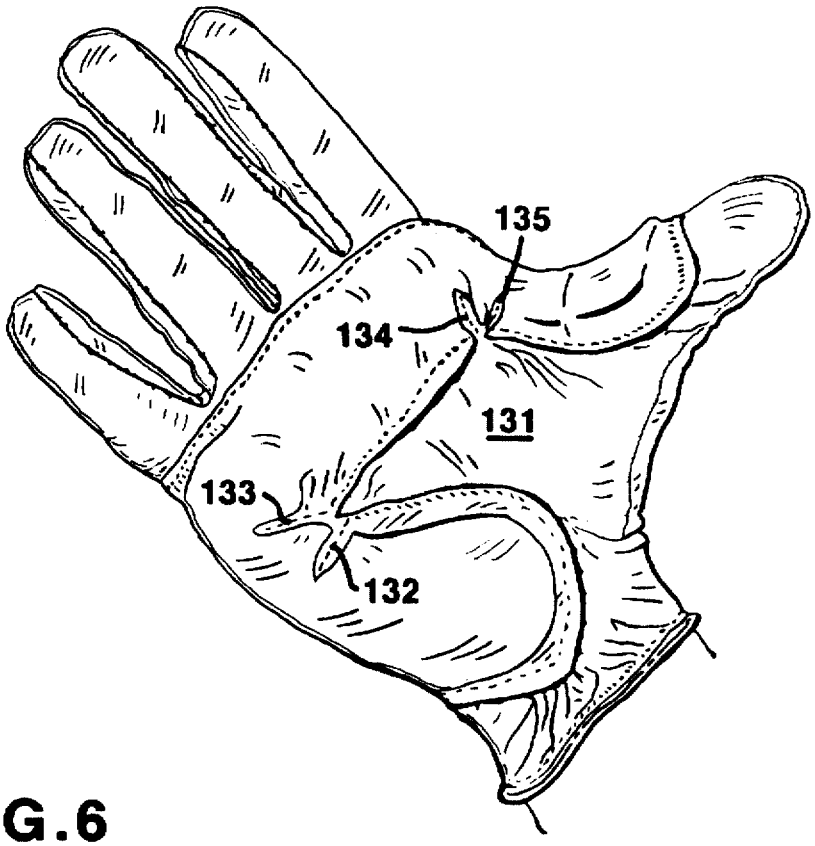

6) FIG. 6 is a perspective view of an assembled right padded glove, on a wearer's hand. The right padded glove and the left padded glove are mirror images of one another, hence only the right is shown.

Figure 7:
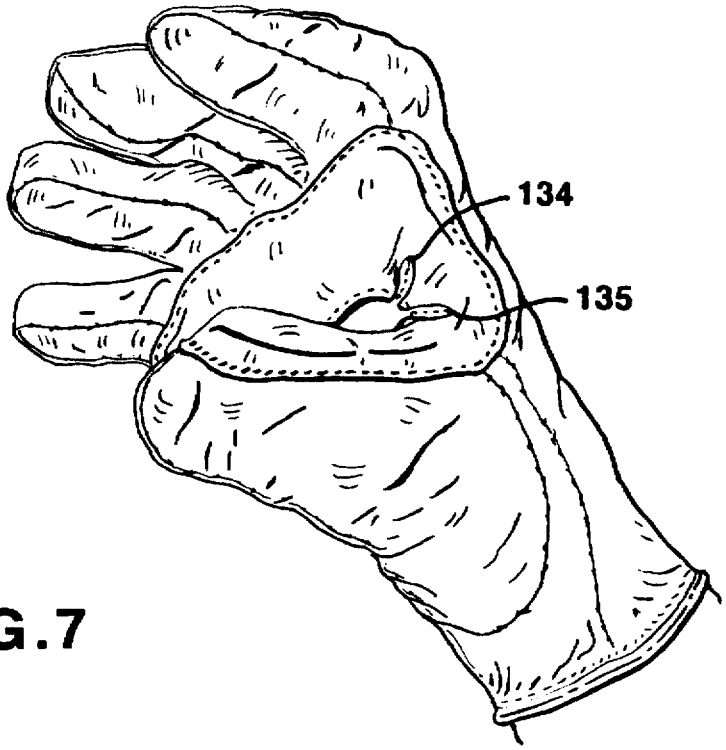

7) FIG. 7 is a perspective view of an assembled right padded glove on a wearers hand, the hand being semi-clenched. The right padded glove and the left padded glove are mirror images of one another, hence only the right is shown.

A DESCRIPTION OF THE PREFERRED EMBODIMENT

A right hand glove and a left hand glove are mirror images of one another, hence, only a right hand glove is shown and described. Furthermore, as the glove pattern and the pieces cut from that glove pattern are nearly identical, the terms applied to the pattern and to the glove pieces prior to assembly are used interchangeably. Hence, only the pattern is described, and the pieces from which the glove will be constructed are discussed only where it would better facilitate understanding of the present invention.

As per FIG. 1, a back trank has a back trank front side (1) and a back trank rear side (2). The back trank has a back trank right edge (3), and a back trank left edge (4). The back trank also has a back trank top (5) and a back trank bottom (6). The back trank top is considered the most proximal area of the back trank and is the area closest to a wrist, when the glove is worn. The back trank bottom is considered the most distal area of the back trank and is the area closest to a fingertip, when the glove is worn. The back trank top (5) and the back trank right edge (3) intersect at a first point (7). The back trank has four back trank lobes depending therefrom; a first back lobe (8) a second back lobe (9) a third back lobe (10) and a fourth back lobe (11). The first back lobe (8) and the third back lobe (10) are of similar length (12). The second back lobe (9) is longer than the first back lobe (8). The fourth back lobe (11) is shorter than the first back lobe (8).

The first back lobe (8) has a first back lobe right side (13) a first back lobe left side (14) and a first back lobe terminating boundary (15). The first back lobe terminating boundary is arc shaped.

The second back lobe (9) has a second back lobe right side (16) a second back lobe left side (17) and a second back lobe terminating boundary (18). The second back lobe terminating boundary is arc shaped.

The third back lobe (10) has a third back lobe right side (19) a third back lobe left side (20) and a third back lobe terminating boundary (21). The third back lobe terminating boundary is arc shaped.

The fourth back lobe (11) has a fourth back lobe right side (22) a fourth back lobe left side (23) and a fourth back lobe terminating boundary (24). The fourth back lobe terminating boundary is arc shaped.

As per FIG. 1, moving distally from a first point (7), the back trank right side (3) proceeds in a straight line toward the terminating boundary of the fourth back lobe (24). The back trank left side merges into the fourth back lobe at a second point (25). The fourth back lobe right side (22) then proceeds distally and merges into the fourth back lobe terminating boundary (24). The fourth back lobe terminating boundary proceeds in the form of an arc, leftward, away from the fourth back lobe right side, and merges into the fourth back lobe right side (23). The fourth back lobe right side proceeds proximally in a straight line to a third point (26).

The third back lobe right side (19) begins at the third point (26) and proceeds in a straight fine distally and merges into the third back lobe terminating boundary (21). The third back lobe terminating boundary proceeds in the form of an arc, leftward, away from the third back lobe right side, and merges into the third back lobe left side (20). The third back lobe left side proceeds proximally in a straight line toward a fourth point (27).

The second back lobe right side (16) begins at the fourth point (27) and proceeds in a straight line distally and merges into the second lobe terminating boundary (18). The second back lobe terminating boundary proceeds in the form of an arc, leftward, away from the second back lobe right side, and merges into the second back lobe left side (17). The second back lobe left side proceeds proximally in a straight line toward a fifth point (28).

The first back lobe right side (13) begins at the fifth point (28) and proceeds in a straight line distally and merges into the first back lobe terminating boundary (15). The first back lobe terminating boundary proceeds in the form of an arc, leftward, away from the second back lobe right side, and merges into the first back lobe left side (14). The first back lobe left side proceeds proximally in a straight line in the direction of the back trank bottom (5). The first back lobe left side merges into the back trank left side at a sixth point (29). The back trank left side the proceeds proximally to a seventh point (30), the seventh point being directly in line with the first point (7).

From the seventh point (30), a back trank bottom edge (31) proceeds in a straight line rightward, and intersects the first point (7). In the preferred embodiment, there is an arch shaped cutout portion along the back trank bottom edge. By cutting out an arch shaped portion of the back trank, the glove, once assembled, is amenable to the addition of an adjustable binding strap bridging the cutout section. The binding strap may be adjusted to conform the glove better to a wearer's hand.

As per FIG. 1, the first back lobe, second back lobe, third back lobe, and fourth back lobe are collectively referred to as the back trank finger section of the glove or the back trank Standard Dress cut finger section.

That portion of the back trank defined by excluding the back trank Standard Dress cut finger section may be referred to as the Gunn cut back section.

The length of the first back lobe may be defined as the distance from the sixth point (29) to the distal most edge of the first back lobe terminating boundary.

As per FIG. 1, for illustrative purposes, the back trank lobes have been separated from one another. The first back lobe right side (13) has been separated from the second back lobe left side (17). The second back lobe right side (16) has been separated from the third back lobe left side (20). The third back right side (19) has been separated from the fourth back lobe left side (23). As is understood in the industry, the lobes are not separated on the pattern piece, but are separated once the material from which the glove is to be assembled has been cut to shape, using the pattern as a guide.

As per FIG. 2, the palm trank has palm trank top (56), a palm trank bottom (55) a palm trank front side (125) and a palm trank back side (126) The palm trank has four palm trank lobes depending therefrom and a Wing thumb section essentially perpendicular to the four palm trank lobes; a fourth palm trank lobe (120), a third palm trank lobe (121) a second palm trank lobe (122) and a first palm trank lobe (123). The first palm trank lobe (123) and the third palm trank lobe (121) are of similar length to the first back trank lobe length (12). The second palm trank lobe (122) is longer than the first palm trank lobe (123). The fourth palm trank lobe (120) is shorter than the first palm trank lobe (123). The first palm trank lobe, second palm trank lobe, third palm trank lobe and fourth palm trank lobe are collectively referred to as the palm trank finger section, or the palm trank Standard Dress cut glove finger section.

As per FIG. 2, the palm trank combines features of a Gunn cut glove and a Standard Dress cut glove. As per FIG. 2, moving distally from an eighth point (32), the palm trank left side (33) proceeds in a straight line toward a terminating boundary (34) of a palm trank fourth lobe (120). The palm trank left side merges into the fourth palm trank lobe at a ninth point (36). The fourth palm trank lobe left side (37) then proceeds distally and merges into the fourth palm trank terminating boundary (34). The fourth palm trank lobe terminating boundary proceeds in the form of an arc, rightward, away from the fourth lobe left side, and merges into the fourth palm trank lobe right side (38). The fourth palm trank lobe right side proceeds proximally in a straight line to a tenth point (39).

The third palm trank lobe left side (40) begins at the tenth point (39) and proceeds in a straight line distally and merges into the third palm trank lobe terminating boundary (41). The third palm trank lobe terminating boundary proceeds in the form of an arc, rightward, away from the third palm trank lobe left side, and merges into the third palm trank lobe right side (42). The third palm trank lobe right side proceeds proximally in a straight line toward an eleventh point (43).

The second palm trank lobe left side (44) begins at the eleventh point (43) and proceeds in a straight line distally and merges into the second palm trank lobe terminating boundary (45). The second palm trank lobe terminating boundary proceeds in the form of an arc, rightward, away from the second palm trank lobe left side, and merges into the second palm trank lobe right side (46). The second palm trank lobe right side proceeds proximally in a straight line toward a twelfth point (47).

The first palm trank lobe left side (48) begins at the twelfth point (47) and proceeds in a straight line distally and merges into the first palm trank lobe terminating boundary (49). The first palm trank lobe terminating boundary proceeds in the form of an arc, rightward, away from the second palm trank lobe left side, and merges into the first palm trank lobe right side (50). The first palm trank lobe right side proceeds proximally in a straight line toward the palm trank top (56), and merges into the wing thumb bottom edge (51) at a thirteenth point (52). The first palm trank lobe left side (48) and the first palm trank lobe right side (50) are parallel. A first palm trank lobe width (53) may be defined as a distance from the first palm trank lobe left side to the first palm trank lobe right side.

As per FIG. 2, for illustrative purposes, the palm trank lobes have been separated from one another. The fourth palm trank lobe right side (38) has been separated from the third palm trank lobe left side (40). The third palm trank lobe right side (42) has been separated from the second palm trank lobe left side (44). The Second palm trank lobe right side (46) has been separated from the first palm trank lobe left side (48). As is understood in the industry, the lobes are not separated on the pattern piece, but are separated once the material from which the glove is to be assembled has been cut to shape, using the pattern as a guide.

As per FIG. 2, the wing thumb bottom edge (51) proceeds, perpendicular to the first palm trank lobe right side (50), rightward, away from the first palm trank lobe right side (50). The wing thumb bottom edge (51) merges into the wing thumb terminating boundary (54). The wing thumb terminating boundary proceeds in the form of an arc, proximally, away from the palm trank bottom section (55) and towards the palm trank top section (56). The wing thumb terminating boundary (54) merges into the wing thumb top edge (57). The wing thumb top edge proceeds, perpendicular to the first palm trank lobe right side (50), leftward, toward the palm trank left side (33). The wing thumb top edge merges into the palm trank right side second section (58) at a fourteenth point (59).

As per FIG. 2, the wing thumb bottom edge (51) proceeds from the thirteenth point (52), in a straight line, perpendicular to the first palm trank lobe right side (50), leftward, toward the palm trank left side (33), to a thirty eighth point (60). The length of Wing thumb bottom edge, between the thirteenth point (52) and the thirty eighth point (60) is approximately one half of the width of the first palm trank lobe (53). As per FIG. 2, this line has not yet been cut. During assembly, this line (the line between the thirteenth point and the thirty eighth point) will be a cut line, and the material used for assembly of the finished glove will be cut along this line, forming a glove thumb crotch, also known as the Wing thumb crotch.

As per FIG. 2, the palm trank right side second section (58) proceeds in the form of an arc, away from the wing thumb top side and toward the palm trank top edge. At a fifteenth point (61), the arc form of the palm trank right side section merges into the palm trank right side straight section (62).

The palm trank right side straight section (62) proceeds in a straight line towards the palm trank top side, parallel to the palm trank first lobe left side (48). The palm trank right side straight section (62) merges into the palm trank top side at a sixteenth point (63).

The palm trank top side (57) proceeds in a straight line from the sixteenth point (63), leftward, perpendicular to the palm trank fourth lobe left side (37), towards the palm trank left side (33). The palm trank top side (57) merges into the palm trank left side (33) at the eighth point (32). The eighth point (32) being directly in line with the sixteenth point (63).

That portion of the palm trank defined by excluding the Dress Cut finger section and the Wing thumb section of the palm trank section, may be referred to collectively as the Gunn cut palm section.

As per FIG. 3, a padding means is referred to as a padded section. The padded section (64) is of a size and shape to allow its attachment to the palm trank. The padded section

(64) peripheral dimension is slightly larger than padding material's peripheral dimension, the padding material to be inserted between the padded section and the palm trank during the assembly of the glove. The padding material should be sized so that the padded section (64) will completely cover the padding material after assembly of the glove.

The absorbance of impacts and vibrations generated by objects held in a gloved hand will depend upon the material used as padding material, and that material's thickness. The padding material should be pliable, compressible, resilient and flexible. In the preferred embodiment, a viscoelastic polymer is used as the padding material. In the preferred embodiment, the padding material has a thickness of approximately 0.25 inches, with a specific gravity of approximately 1.03, a Shore 00 durometer of approximately 10 to 20, a stress at 200% elongation ASTM D-412 psi of approximately 8, and an ultimate tensile strength ASTM D-412 of approximately 12. However, different materials may be utilized, the choice of material dictating the thickness of the padding material, the resilience of the padding material and the ability of the padding material to absorb impact and vibration.

As per FIG. 3, the padded section (64) is shaped roughly like the letter "C", or kidney shaped. The padded section has a padded section body (69) formed of a padded section body top edge (65), a padded section body bottom edge (66), a padded section right side (67) and a padded section left side (68). The padded section body top edge and the padded section body bottom edge are substantially parallel to one another. The padded section (64) has a right padded section lobe (70) and a left padded section lobe (71), the right padded section lobe and the left padded section lobe merging into the padded section body, and depending therefrom. The peripheral dimensions of the padded section is equal to the cumulative dimensions of the padded section body, the right padded lobe and the left padded lobe.

As per FIG. 3, starting at a seventeenth point (72), the padded section body top edge (65) proceeds away from the padded section right side (67), towards the padded section left side (68), to a thirty ninth point (73). In the preferred embodiment, the padded section body top edge is not straight, but rather bulges at the center of the padded section top edge, away from the padded section body bottom edge. This bulge permits a more satisfactory configuration for the padded section once assembled onto the glove, as it more nearly resembles the physical configuration of the palm of the hand in terms of being in close proximity to the hand's most proximal finger joints, where the fingers meet the palm. Therefore, by having a bulge along the padded body section top edge, the pad will better cover the area of the palm corresponding to the underside of the knuckles, and provide greater protection from vibrations and impacts generated by articles held in a glove clad clenched fist.

As per FIG. 3, the padded section body top edge (65) merges into a left padded section lobe top edge (74) at the thirty ninth point (73). The left padded section lobe top edge (74) proceeds, in the shape of an arc, leftward, away from the thirty ninth point (73), toward an eighteenth point (75), and merges into a left padded section lobe left edge (76).

As per FIG. 3, the left padded section lobe left edge (76) extends downward, away from the padded section body top edge (65), in an arc shape, to a nineteenth point (77). In the preferred embodiment, the arc is somewhat flattened between the eighteenth point (75) and the nineteenth point (77). However, the degree of curvature of this arc may be changed in order to facilitate attachment to different sized gloves, the different sized gloves potentially having slightly different proportions.

As per FIG. 3, the left padded section lobe left edge (76) proceeds from the nineteenth point (77) in an arc shape to a twentieth point (78). The arching configuration of the left lobe padded section left edge between points nineteen (77) and twenty (78) is oriented leftward, tangentially away from the padded section top edge (65). As per FIG. 3, the left padded section lobe left edge merges into a left padded section bottom edge (79) at the twentieth point (78). The left padded section bottom edge (79) proceeds away from the twentieth point, in an arc shape, to a twenty first point (80). The arching configuration of the left lobe padded section bottom edge between points twenty (78) and twenty one (80) is oriented rightward, tangentially away from the padded section body top edge (65).

As per FIG. 3, the left padded lobe bottom edge merges into a left padded lobe right edge (81) at the twenty first point (80). The left padded lobe right edge (81) proceeds toward a twenty second point (82). In the preferred embodiment, the left padded lobe right edge between points twenty one (80) and twenty two (82) is substantially straight, however, the left padded lobe right edge could be arc shaped, so long as the arc is sufficiently flat to leave an unpadded area in the center of the assembled glove's palm area. As per FIG. 3, the left padded lobe right edge proceeds away from point twenty two (82) to a twenty third point (83). In the preferred embodiment, the left padded lobe right edge between points twenty two (82) and twenty three (83) is essentially straight, though it could also be slightly arched.

As per FIG. 3, the left padded lobe right edge (81) merges into the padded section body bottom edge (66) at the twenty third point (83). As noted above, the padded section body bottom edge (66) is parallel to the padded section body top edge (65). In the preferred embodiment, the padded section body bottom edge is substantially straight. However, the padded section body bottom edge could be slightly arched toward, or away from, the padded section body top edge. As per FIG. 3, the padded section body bottom edge (66) proceeds away from the twenty third point (83), towards a twenty fourth point (84). At the twenty fourth point (84) the padded section body bottom edge merges into a right padded lobe left edge (85).

As per FIG. 3, the right padded lobe left edge (85) proceeds downward, away from the padded section body bottom edge (66) and the padded section body top edge (65), towards a twenty fifth point (86). The right padded lobe left edge locatable between the twenty fourth point (84) and the twenty fifth point (86) is oriented at an angle obtuse to the padded section body bottom edge (66), the twenty fifth point (86) being closer to the left padded lobe right edge (81) (that section of the left padded lobe right edge locatable between the twenty first point (80) and the twenty third point (83)) than is the twenty fourth point (84). Although in the preferred embodiment the right padded lobe left edge (85) locatable between points twenty four (84) and twenty five (86) is substantially straight, an arching configuration could be used.

As per FIG. 3, the right padded lobe left edge (85) proceeds from the twenty fifth point (86) to a twenty sixth point (87), in the form of an arc, merging into a right padded lobe bottom edge (88) at the twenty sixth point (87). In the preferred embodiment, an arc leg closest to the twenty sixth point (87) is shorter than an arc leg closest to the twenty fifth point (86). In this fashion, a better fit is accomplished along the thumb section once the glove has been assembled, and the padded section is attached to the glove.

As per FIG. 3, the right padded lobe bottom edge (88) proceeds away from the twenty sixth point (87) to a twenty seventh point (90), in the shape of an arc. The right padded lobe bottom edge merges into a right padded lobe right edge (89) at the twenty seventh point (90). The right padded lobe right edge proceeds in the form of an arc, upwards and away from the twenty seventh point (90), toward the padded section body top edge (65), to a twenty eighth point (91).

As per FIG. 3, the right padded lobe right edge (89) merges into a right padded lobe top edge (92) at the twenty eighth point (91). The right padded lobe top edge (92) proceeds upward and toward the padded section body top edge, in the shape of an arc, and merges into the padded section body top edge at the seventeenth point (72).

As per FIG. 4, a thumb back (93) has a thumb back body (94) a thumb back lobe (95) and a thumb back squared lobe (96). Beginning at a twenty ninth point (97), proceeding in a straight line towards a thirtieth point (98) a thumb back body bottom edge (99) is thereby described. The thumb back body bottom edge (99) is substantially straight. The thumb back body bottom edge merges (99) into a thumb back lobe terminating edge (100) at the thirtieth point (98). The thumb back lobe terminating edge (100) is arch shaped. The thumb back lobe terminating edge (100) is shaped and sized proportionally to allow its attachment to the palm trank Wing thumb (124) during glove assembly.

As per FIG. 4, the thumb back lobe terminating edge merges into a thumb back lobe right edge (101) at the thirty first point (102). The thumb back lobe right edge proceeds, in the shape of an arc, to a thirty second point (103). The open legs of the arc point away tangentially from the twenty ninth point (97).

As per FIG. 4, the thumb back lobe right edge (101) merges into a thumb back squared lobe left edge (104) at the thirty second point (103). The thumb back squared lobe left edge (104) proceeds in the shape of a straight line, to a thirty third point (105).

As per FIG. 4, the thumb back squared lobe left edge (104) merges into a thumb back squared lobe top edge (106) at the thirty third point (105). The thumb back squared lobe top edge proceeds, in the shape of a straight line, to a thirty fourth point (107). The thumb back squared lobe top edge (106), locatable between the thirty third point (105) and the thirty fourth point (107), is perpendicular to the thumb back squared lobe left edge (104) locatable between the thirty second point (103), and the thirty third point (105).

As per FIG. 4, the thumb back squared lobe top edge (106) merges into a thumb back squared lobe right edge (108) at the thirty fourth point (107). The thumb back squared lobe right edge (108) proceeds in the shape of a straight line, toward the twenty ninth point (97), to a thirty sixth point (109).

As per FIG. 4, the thumb back squared lobe right edge (108) merges into a thumb back body top edge (110) at the thirty sixth point (109). The thumb back body top edge (110) proceeds away from the thirty sixth point (109) in the shape of a slightly arched straight line, to a thirty seventh point (111).

As per FIG. 4, the thumb back body top edge (110) merges into a thumb back body right edge (112) at the thirty seventh point (111). The thumb back body right edge (112) proceeds in the shape of a straight fine, to the twenty ninth point (97). The thumb back body right edge (112) merges into the thumb back body bottom edge (99) at the twenty ninth point (97).

As per FIG. 5, a two piece fitted fourchette has a top terminating edge (137), a right edge (114), a bottom right edge (115), a bottom terminating edge (116), a bottom left edge (117), a left edge (118), and a center cut line (119). Two piece fitted fourchettes are well known in the industry, and are used to connect the finger section of the palm trank and the finger section of the back trank to one another, in the area which would be between the fingers (first, second, third and fourth lobes), when the glove is assembled.

As is well known in the industry, the two piece fitted fourchette, once cut from the material to be assembled into the glove, will be cut along the center cut line (119). Having been cut along the center cut line, there will be a first fitted fourchette (127) and a second fitted fourchette (128). The first fitted fourchette will be composed of one half of the top terminating edge (137), a right edge (114), a bottom right edge (115), one half of the bottom terminating edge (116) and a first fourchette left edge (129) the first fourchette left edge corresponding to the center cut line (119) prior to cutting. The second fitted fourchette will be composed of one half of the top terminating edge (137), a left edge (118) a bottom left edge (117), one half of the bottom terminating edge (116) and a second fourchette right edge (130). The second fourchette right edge corresponding to the center cut line (119), prior to cutting.

As is further known in the industry, and by way of example, the first fitted fourchette and the second fitted fourchette are attached to one another, and along the palm trank finger section and the back trank finger section via means for attachment during assembly. The first fitted fourchette is attached along the first fourchette left edge (129) to the back trank first back lobe right side (13) and the first back lobe terminating boundary (15), via means for attachment. The first fitted fourchette is attached along the right edge (114) to the first palm trank lobe left side (48) and the first palm trank lobe terminating boundary (49), via means for attachment.

Continuing the example, the second fitted fourchette is attached along the second fourchette right edge (130) to the second back lobe left side (17) and the second back lobe terminating boundary (18) via means for attachment. The second fitted fourchette is attached along the left edge (118) to the second palm trank lobe right side (46) and the second palm trank lobe terminating boundary (45), via means for attachment. The second fitted fourchette is attached along the bottom left edge (117) to the first fitted fourchette bottom right edge (115) and along and one half of the bottom terminating edge (116) to one half of the bottom terminating edge (116) of the first fitted fourchette.

This pattern is repeated for the entire finger section, with two exceptions. The first exception being the attachment of the first palm trank lobe right side (50) to the first back lobe left side (14), and the attachment of the first palm trank lobe terminating boundary (49) to the first back lobe terminating boundary (15) along those sections of the boundaries not attached to the first fourchette (127). The second exception being the attachment of the fourth palm trank lobe left side (37) to the fourth back lobe right side and (22) the attachment of the fourth palm trank lobe terminating boundary (34) to the fourth back lobe terminating boundary (24) along those sections of the boundaries not attached to the second fourchette (128).

The pattern pieces described above should be used to prepare the actual pieces which will be assembled into the finished glove. This process is also well known in the industry.

Once the palm trank with Wing thumb, the back trank, the padded section, the thumb back and the two piece fitted fourchette have been cut from the material of which the glove is to be constructed, using the above described pattern pieces as a guide, the glove is assembled.

Assembly of the finger section of the palm trank, the finger section of the back trank and the two piece fitted fourchettes is accomplished in the manner in which a Standard Dress cut glove is usually assembled by the industry. The thumb back and the Wing thumb section of the palm trank are assembled in the same manner in which a Gunn cut glove having a wing thumb is usually assembled by the industry. Those sections of the glove not otherwise noted are assembled in the same manner in which a Gunn cut glove having a Wing thumb are usually assembled by the industry.

The padded section is attached to the palm trank and the Wing thumb section of the palm trank via means for attachment. In the preferred embodiment, the means for attachment is thread which is used to stitch the padded section onto the palm trank and the Wing thumb section of the palm trank, as well as in the assembly of all other pieces.

As per FIGS. 2, 3, 6 and 7, the padded section is attached to the assembled glove. The padded section body top edge (65) is attached to the glove in dose proximity to the tenth point (39), the eleventh point (43) and the twelfth point (47). The left padded section lobe (71) and the right padded section lobe (70) depend from the padded section body (69) toward the palm trank top (56). The padded section is attached along its entire periphery, to the palm trank and the wing thumb section of the palm trank.

As per FIGS. 2, 3, 6 and 7, the left padded section lobe (71) is attached along the palm trank left side (33). The attachment area for the right padded section lobe is locatable along the palm trank first lobe right side (50), the attachment along the palm trank first lobe right side extends proximally, toward the Wing thumb section of the palm trank (124). The attachment continues along the bottom edge of the wing thumb section of the palm trank, between the thirty eighth point (60) and the thirteenth point (52). The attachment continues along the bottom edge of the wing thumb section of the palm trank approximately one half the distance between the thirteenth point (52) and edge of the Wing thumb terminating boundary located most distantly from the palm trank left side edge (33). The padded section right lobe, once attached, ends at approximately the same location where the most distal joint of the thumb would be located when the assembled glove is worn.

As per FIGS. 3, 6 and 7, the padded section attachment continues along the right padded section lobe left side (85), to the padded section body bottom edge (66). The attachment continues along the padded section body bottom edge to the left padded section lobe right edge (81). The attachment of the padded section along the area defined by the right padded section lobe left edge (85), the padded section body bottom edge (66) and the left padded section lobe right edge (81) forms an open palm area (131).

As per FIGS. 6 and 7, all remaining unattached peripheral edges of the padded section are attached such that the entire periphery of the padded section is attached to the palm trank and the Wing thumb section of the palm trank.

As per FIGS. 3, 6 and 7, additional attachments are made along a first flexure area (132), a second flexure area (133), a third flexure area (134), and a fourth flexure area (135). The first flexure area may be defined by a straight line running from the twenty second point (82), approximately one half the distance to the nineteenth point (77). The second flexure area may be defined by a straight line running from the twenty third point (83), approximately one half the distance to the eighteenth point (75). The third flexure area may be defined by a straight line running from the twenty fourth point (84) approximately one half the distance to the twenty eighth point (91). The fourth flexure area may be defined by a straight line running from the twenty fifth point (86) approximately one half the distance to the twenty seventh point (90). Although in the embodiment, the first flexure area, the second flexure area, the third flexure area the fourth flexure area are specified as being approximately one half the length of the distance between two points, they could be as little as one quarter the length or as great as the entire distance.

The attachment of the padded section and the glove, through the padding material, should be as tight as possible along the flexure areas. This permits the glove to fold more easily along these flexure areas, and prevents the padding material from bunching outward, away from the palm of the glove, when the gloved hand is closed.

I claim:

1. A padded glove pattern comprising;

A. a back trank pattern piece,

I. the back trank pattern piece having a Gunn cut section;

II. the back trank pattern piece having a back trank front side, a trank back side, a back trank right edge, a back trank left edge, a back trank top and a back trank bottom, III. the back trank pattern piece having a back trank pattern piece Standard Dress cut finger section, a. the back trank pattern piece Standard Dress cut finger section having a first back lobe, a second back lobe, a third back lobe and a fourth back lobe, i. the first back lobe merging into, and being an extension of, the back trank Gunn cut section, the first back lobe having first back lobe length, ii. the second back lobe being adjacent to the first back lobe, the second back lobe merging into, and being an extension of, the back trank Gunn cut section, iii. the third back lobe being adjacent to the second back lobe, the third back lobe merging into, and being an extension of, the back trank Gunn cut section, iv. the fourth back lobe being adjacent to the third back lobe, the fourth back lobe merging into, and being an extension of, the back trank Gunn cut section;

B. a palm trank pattern piece,

I. the palm trank pattern piece having a palm trank Gunn cut palm section, a. the palm trank pattern piece Gunn cut palm section being sized and proportioned similarly to the back trank Gunn cut section, II. the palm trank pattern piece having a palm trank Standard Dress cut finger section, a. the palm trank pattern piece Standard Dress cut finger section having a first palm trank lobe, a second palm trank lobe, a third palm trank lobe and a fourth palm trank lobe, i. the first palm trank lobe merging into, and being an extension of, the palm trank Gunn cut palm section, ii. the second palm trank lobe merging into, and being an extension of, the palm trank Gunn cut palm section, iii. the third palm trank lobe merging into, and being an extension of, the palm trank Gunn cut palm section, iv. the fourth palm trank lobe merging into, and being an extension of, the palm trank Gunn cut palm section, b. the palm trank Standard Dress cut finger section being sized and proportioned similarly to the back trank Standard Dress cut finger section, III. the palm trank pattern piece having a wing thumb section, a. the wing thumb section being an extension of and merging into the palm trank Gunn cut palm section, i. the Wing thumb section extending away from the Gunn cut palm section, perpendicularly to the fourth palm trank lobe, at a horizontal elevation equal to a horizontal elevation within which the palm trank pattern piece extends;

C. a two-piece fitted fourchette pattern piece,

I. the two-piece fitted fourchette pattern piece having a center cut line, a. the center cut line having a length similar to first back lobe length;

D. a thumb back pattern piece,

I. the thumb back pattern piece having a thumb back body,

II. the thumb back pattern piece having a thumb back pattern piece first lobe, a. the thumb back pattern piece first lobe having an arc shaped terminating boundary, III. the thumb back pattern piece having a thumb back pattern piece squared lobe, IV. the thumb back pattern piece being sized proportionally to the palm trank pattern piece wing thumb section;

E. a padding section pattern piece,

I. the padding section pattern piece being roughly "C" shaped or kidney shaped,

II. the padding section pattern piece having a padded section body,

III. the padding section pattern piece having a right padded section lobe, a. the right padded section lobe being attached to the padded section body and depending therefrom, IV. the padding section pattern piece having a left padded section lobe, a. the left padded section lobe being attached to the padded section body, and depending therefrom.

2. A padded glove comprising;

A. a back trank,

I. the back trank having a back trank Gunn cut section,

II. the back trank having a back trank Standard Dress cut finger section, a. the back trank Standard Dress cut finger section having a first back trank lobe, a second back trank lobe, a third back trank lobe and a fourth back trank lobe, i. the first back trank lobe merging into, and being an extension of, the back trank Gunn cut palm section, aa. the first back trank lobe having a right side, a left side, and a terminating boundary, ii. the second back trank lobe being adjacent to the first back trank lobe, the second back trank lobe merging into, and being an extension of, the back trank Gunn cut palm section, aa. the second back trank lobe having a right side, a left side and a terminating boundary, iii. the third back trank lobe being adjacent to the second back trank lobe, the third back trank lobe merging into, and being an extension of, the back trank Gunn cut palm section, aa. the third back trank lobe having a right side, a left side, and a terminating boundary, iv. the fourth back trank lobe being adjacent to the third back trank lobe, the fourth back trank lobe merging into, and being an extension of, the back trank Gunn cut palm section, aa. the fourth back trank lobe having a right side, a left side and a terminating boundary;

B. a palm trank,

I. the palm trank having a Gunn cut palm section, a. the palm trank Gunn cut palm section being attached to the back trank Gunn cut section via means for attachment, II. the palm trank having a palm trank Standard Dress cut finger section, a. the palm trank Standard Dress cut finger section having a first palm trank lobe, a second palm trank lobe, a third palm trank lobe and a fourth palm trank lobe, i. the first palm trank lobe merging into, and being an extension of, the palm trank Gunn cut palm section, aa. the first palm trank lobe having a left side, right side and a terminating boundary, the first palm trank lobe right side being attached to the first back lobe left side, ii. the second palm trank lobe merging into, and being an extension of, the palm trank Gunn cut palm section, aa. the second palm trank lobe having a left side, a right side, and a terminating boundary, iii. the third palm trank lobe merging into, and being an extension of, the palm trank Gunn cut palm section, aa. the third palm trank lobe having a left side, a right side, and a terminating boundary, iv. the fourth palm trank lobe merging into, and being an extension of; the palm trank Gunn cut palm section, aa. the fourth palm trank lobe having a left side, a right side and a terminating boundary, the fourth palm trank lobe left side being attached to the fourth back trank lobe right side via means for attachment, III. the palm trank pattern having a wing thumb section, a. the wing thumb section extending from and being attached to the palm trank Gunn cut palm section;

at least three, two-piece fitted fourchettes,

I. the two-piece fitted fourchette having a top terminating edge, a right edge, a bottom right edge, a bottom terminating edge, a bottom left edge, a left edge and a center cut line, a. the two piece fitted fourchette center cut line being cut such that a first fourchette and a second fourchette are thereby formed, i. the first fourchette having one half of the top terminating edge, the right edge, the bottom right edge, one half of the bottom terminating edge, and a first fourchette left edge, aa. the first fitted fourchette being attached along the palm trank Standard Dress cut finger section via means for attachment, bb. the first fitted fourchette being attached along the back trank Standard Dress cut finger section via means for attachment, ii. the second fourchette having one half of the top terminating edge, the left edge, the bottom left edge, one half of the bottom terminating edge, and a second fourchette right edge, aa. the second fitted fourchette being attached along the palm trank Standard Dress cut finger section via means for attachment, bb. the second fitted fourchette being attached along the back trank Standard Dress cut finger section via means for attachment, cc. the second fitted fourchette bottom left edge being attached to the first fitted fourchette bottom right edge via means for attachment;

D. a thumb back,

I. the thumb back having a thumb back body, a. the thumb back body being attached to the palm trank, and the back trank, via means for attachment, b. the thumb back body having a thumb back lobe extending therefrom, i. the thumb back lobe being attached to the palm trank wing thumb via means for attachment, c. the thumb back body having a thumb back squared lobe extending therefrom, i. the thumb back squared lobe being attached to the palm trank and the back trank via means for attachment;

E. a padding means,

I. the padding means being attached to the palm trank and the palm trank wing thumb via means for attachment, a. the means for attachment which attach the padding means to the palm trank forming flexure areas on the padding means.

3. The padding means of claim 2, the padding means further comprising,

A. a padded section,

I. the padded section being shaped roughly like the letter "C", or "kidney" shaped, II. the padded section having a padded section body, a. the padded section body having a padded section body top edge, a padded section body bottom edge, a padded section body right side and a padded section body left side, i. the padded section body top edge being substantially parallel to the padded section body bottom edge, III. the padded section having a right padded section lobe, a. the right padded section lobe being connected to the padded section body at the padded section body top edge, the padded section body bottom edge, and the padded section body right side, b. the right padded section lobe depending from the padded section body, perpendicular to the padded section top edge, IV. the padded section having a left padded section lobe, a. the left padded section lobe being connected to the padded section body at the padded section body top edge, the padded section body bottom edge, and the padded section body left side, b. the right padded section lobe depending from the padded section body, perpendicular to the padded section top edge;

B. padding material,

I. the padding material having a peripheral dimension slightly smaller than the padded section, II. the padding material being flexible, compressible and resilient.

* * * * *